US006777635B2

(12) United States Patent
Baginski et al.

(10) Patent No.: US 6,777,635 B2
(45) Date of Patent: Aug. 17, 2004

(54) VERY HIGH-SPEED LIMITING ELECTRICAL SWITCHGEAR APPARATUS

(75) Inventors: Pierre Baginski, Grenoble (FR); Grégoire Brun, Sinard (FR); Jean-Paul Ferrand, Voreppe (FR); Jacques Joubert, Montbonnot Saint Martin (FR); Christian Pellegrin, Coublevie (FR); Richard Vacher, Le Fontanil Cornillon (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/391,589

(22) Filed: Mar. 20, 2003

(65) Prior Publication Data

US 2003/0179525 A1 Sep. 25, 2003

(30) Foreign Application Priority Data

Mar. 22, 2002 (FR) ..... 02 03586

(51) Int. Cl.[7] ..... H01H 23/00
(52) U.S. Cl. ..... 200/401; 200/400; 218/22
(58) Field of Search ..... 200/400, 401, 200/402, 175; 218/22, 31–33, 153, 154; 335/6, 16, 147, 21–27, 35, 167–175

(56) References Cited

U.S. PATENT DOCUMENTS 3,546,641 A 12/1970 Freeeman ..... 335/16
4,862,313 A * 8/1989 Shirouzu et al. ..... 335/174
4,952,897 A * 8/1990 Barnel et al. ..... 335/147
5,571,255 A * 11/1996 Baginski et al. ..... 200/401
5,731,560 A * 3/1998 Nebon et al. ..... 218/22
6,204,743 B1 * 3/2001 Greenberg et al. ..... 335/172
6,211,757 B1 * 4/2001 Castonguay et al. ..... 335/6
6,479,774 B1 * 11/2002 Castonguay et al. ..... 200/401

FOREIGN PATENT DOCUMENTS

DE 3841592 A1 6/1989
EP 0 789 380 A1 8/1997
FR 1294693 5/1962

* cited by examiner

*Primary Examiner*—Lincoln Donwan
*Assistant Examiner*—M. Fishman
(74) *Attorney, Agent, or Firm*—Parkhurst & Wendel, L.L.P.

(57) ABSTRACT

A limiting circuit breaker comprises two separable contacts 68, 70 and a mechanism 12 with energy storage 36 operated by an opening catch 30. The mechanism 12 drives a movable cage 58 between a closed position and an open position to perform opening of the contacts. One of the contacts is movable with respect to the cage 58 in the closed position and can thus take a separated position. A Thomson effect electromechanical actuator 100 is provided to drive the movable contact 68 to the separated position. A latch 80 enables the movable contact to be held in the separated position. In the event of a fault requiring a very high-speed response, separation of the contacts is obtained by means of the Thomson effect actuator and is then confirmed by opening of the mechanism. In other cases, only the mechanism operates to perform opening.

17 Claims, 4 Drawing Sheets

VERY HIGH-SPEED LIMITING ELECTRICAL SWITCHGEAR APPARATUS

BACKGROUND OF THE INVENTION

The invention relates to a very high-speed electrical switchgear apparatus having the function of a limiting circuit breaker.

STATE OF THE PRIOR ART

In the document EP 0,309,311 a limiting circuit breaker is described with high-speed opening control of the contacts by Thomson effect, each pole-unit of which circuit breaker is equipped with a movable assembly having a movable main bridge forming a main circuit with a pair of stationary main contacts connected to current input terminal strips, and a movable arcing contact bridge forming, with a pair of stationary arcing contacts, an arcing circuit connected in parallel with the main circuit. A Thomson effect thrust means drives the movable assembly for opening of the main circuit and of the arcing circuit. A latching device holds the movable assembly in the open position against the bias of return springs tending to return the movable assembly to the closed position. A second Thomson effect thruster serves the purpose of unlatching the latching device.

All the circuit breaker openings, whether it be simple operations or openings on faults, are caused by the Thomson effect actuator which therefore has to be dimensioned for a very large number of cycles. The Thomson effect actuator drives the contacts over the whole opening travel. Furthermore, the Thomson effect actuator requires its own electric power supply and, in case of failure of the latter, there is no subsidiary means of operating the apparatus. Moreover, the apparatus thus designed is very specific with respect to low-voltage power circuit breakers of conventional design which constitute the vast majority of the range, so that its cost remains high. Finally, the openings and closings by means of the Thomson effect actuator are extremely snappy, regardless of the type of fault. The mechanism of the apparatus therefore suffers considerably during the opening and closing cycles.

To limit shocks, it has been proposed in the document FR 2,377,086 to subdivide the electric power storage means by capacitors providing the power supply for the Thomson effect actuator into two parts. In case of opening under normal conditions, only one of the two parts is used whereas in case of an electric fault, both the parts of the energy storage means are used, a greater power then being available.

To operate Thomson effect limiting circuit breakers, electric short-circuit detection processes are known supplying a short-circuit detection signal very quickly and very reliably enabling high-speed operation of an electromechanical relay performing unlatching of a mechanism of the circuit breaker. The document DE 3,642,136 describes such a detection process using a current intensity signal and a current intensity differential signal to make a very quick decision as to the existence of a short-circuit. Early short-circuit detection combined with the speed of reaction of the Thomson effect actuator gives the circuit breaker a high-performance limiting function enabling it to break almost infinite prospective currents. However, the limiting function is only achieved by tripping of the circuit breaker, so that it does not enhance down-line selectivity in a distribution panel.

Circuit breakers are moreover known opening whereof is achieved by a spring-loaded mechanism and having a very short response time when tripping occurs on a fault. It has notably been proposed, in the document EP 780,380 A1, to use the mechanical reaction arising from electrodynamic compensation of the compensated contact means to bring about automatic tripping. The opening pawl comprises disengageable actuating means causing self-unlatching of the latch in the presence of a short-circuit current exceeding a calibration threshold defined by a spring, said self-unlatching being commanded from a mechanical reaction generated by the electrodynamic compensation effect and causing very fast rotation of the latch to unlatch the opening pawl before the trip means operates. To further improve the above device, it has been proposed, in the document FR 2,781,921, to add thereto electromagnetic limiting means performing separation of the contact fingers to limit very strong currents pending opening of the mechanism. The circuit breaker obtained has very high performances, but separation of the contact fingers by electromagnetic reaction cannot take place before the current intensity has exceeded a limiting threshold.

SUMMARY OF THE INVENTION

The object of the invention is therefore to remedy the shortcomings of the state of the art so as to propose an extremely reliable, relatively compact, low-cost limiting circuit breaker with very high-speed opening, enabling separation of the contacts and a limiting effect to be achieved without the current intensity having exceeded a limiting threshold.

For this purpose, the object of the invention is to provide an electrical switchgear apparatus comprising:

- a first contact connected to a first terminal strip for connection to an electric power circuit;
- a cage movable between a closed position and an open position;
- a second contact electrically connected to a second terminal strip for connection to the electric power circuit, the second contact being movable with respect to the cage between a contact position and a separated position, the second contact being in contact with the first contact when the cage is in the closed position and the second contact is in the contact position,
- a drive mechanism of the apparatus movable between a closed position and an open position, comprising:
  - an energy storage spring loaded when the drive mechanism is in the closed position and unloading when moving the drive mechanism from the closed position to the open position;
  - an opening latch, locking the drive mechanism in the open position;
  - an electromechanical relay for operation of the opening latch;
  - a kinematic transmission system between the energy storage spring and the cage to drive the cage from the closed position to the open position when the drive mechanism moves from the closed position to the open position;
- an electromechanical actuator comprising a movable assembly moving between a rest position and an active position and driving the second contact from the contact position to the separated position going from the rest position to the active position, when the cage is in the closed position.

The presence of a drive mechanism independent from the actuator first of all makes it possible to limit the number of operations that have to be performed by the high-speed actuator since certain of the openings will be able to be performed by actuating the mechanism latch. In addition, the actuator only has to supply the energy required for moving the second contact to the separated position. When opening is confirmed by an unlatching order of the opening latch, the mechanism drives the contact support to the open position which has the effect of separating the movable contact even further from the first contact. In other words, a part of the travel of the movable contact with respect to the stationary contact is performed by the opening spring of the mechanism. The dimensioning of the actuator and associated electronics is thereby greatly simplified.

The redundance of the opening functions in addition enables downrated operation when malfunctioning of the electric power supply or power electronics associated to the very high-speed actuator, or even of the actuator itself, occurs. In this case, the circuit breaker in fact acts as a conventional limiting circuit breaker. The global reliability of the breaking function of the apparatus is thereby improved.

Furthermore, in so far as closing is performed by the mechanism, it is possible in case of closing on a fault to achieve immediate separation of the contacts by means of the actuator.

Preferably the apparatus in addition comprises a contact pressure spring urging the second contact to the contact position when the second contact is near to the contact position.

According to a first embodiment, the contact pressure spring bears on the movable cage. According to an alternative embodiment, the contact pressure spring bears on a support of the apparatus, the second contact being connected to the cage by a kinematic link.

Advantageously, the drive mechanism comprises closing means to move the drive mechanism from the open position to the closed position, the kinematic transmission system driving the cage from the open position to the closed position when the drive mechanism moves from the open position to the closed position. The closing means comprise a closing spring which relaxes to move the mechanism from the open position to the closed position. The energy storage spring is then said to be an opening spring to distinguish it from the closing spring. The apparatus may be of the type wherein the energy necessary to load the opening spring is first of all stored in the closing spring, relaxation of the closing spring enabling the opening spring to be loaded. Alternatively, it may be of the type wherein the energy necessary to load the closing spring is first of all stored in the opening spring, relaxation of the opening spring enabling the closing spring to be loaded. According to another embodiment, a single spring can perform both closing and opening on a fault.

According to one embodiment, the apparatus in addition comprises a means for retaining the second contact in a retention position situated between the contact position and the separated position so long as the cage is in the closed position. These retention means enable holding in the retention position to be achieved, pending opening of the mechanism by the energy storage spring. Preferably the retention means includes an anti-return latch movable between a neutral position and an anti-return position and moving from the neutral position to the anti-return position when the second contact moves from the contact position to the separated position, the anti-return latch in the anti-return position locking the second contact in a locked position near to the separated position so long as the cage is in the closed position. Positive locking of the second contact is thus achieved, resulting in efficient latching even in the case where the second contact, thrust by the actuator, bounces on reaching the separated position. Alternatively, a bistable articulation mechanism between the second contact and the cage can be achieved by means of the contact pressure springs, so that when the second contact is near to the separated position, it is urged to the separated position by the contact pressure spring. Such a device does however present the shortcoming of being less reliable in the event of violent bouncing of the second contact in the separated position. A top end-of-travel stop able to absorb the kinetic energy of the second contact should then be provided for the second contact.

Preferably, the apparatus in addition comprises an arc extinguishing chamber equipped with means for absorbing energy given off by an electric arc drawn between the first contact and the second contact when the second contact is separated from the first contact, means for projecting an electric arc drawn between the first contact and the second contact by electromagnetic effect to the arc extinguishing chamber.

These means enable the energy of the electric arc to be absorbed as soon as the contacts are separated by the electromagnetic actuator, without waiting for confirmation of opening by the drive mechanism. Preferably, the chamber and the means for electromagnetic propulsion of the arc are dimensioned in such a way that the arc is extinguished even before the drive mechanism has been able to move the cage. In practice, projection of the arc to the chamber is obtained notably by giving the conductors connecting the contacts to the connection terminal strips a suitable shape, for example the shape of a current loop. A U-shaped magnetic circuit surrounding the contact zone can also be inserted to produce a strong electromagnetic field in the zone where the electric arc arises when separation of the contacts takes place.

Advantageously, the apparatus in addition comprises an electric power supply device to supply the electromechanical actuator and deliver the electric power required to make the movable assembly go from the rest position to the active position. The electric power supply device comprises an electric power storage means. In practice, this involves one or more power capacitors which enable electric power to be stored and restored almost instantaneously to supply power to the actuator. According to one embodiment, the electric power supply device is connected to an electric source independent from the electric power circuit. However, it can also be envisioned to provide a control whose electric power source is the electric power circuit wherein the contacts of the apparatus are situated.

The operating mechanism of the apparatus can be constructed according to different layouts. In the case of a circuit breaker, the following can be provided:

means for detecting electric faults and for discriminating between electric faults requiring high-speed opening and electric faults not requiring high-speed opening;

operating means to operate both the electromechanical relay and the electric power supply device when the means for detecting and discriminating have decided that the electric fault requires high-speed opening and to operate the electromechanical relay alone when the means for detecting and discriminating have decided that the electric fault does not require high-speed opening.

Alternatively the following can be provided:

measuring means for measuring an electric characteristic of the electric power circuit;

a trip device of the mechanism connected to the measuring means and to the electromechanical relay to operate the electromechanical relay;

a high-speed opening device connected to the measuring means and to the electric power supply device to operate the electromechanical actuator when the electric fault requires high-speed opening.

According to another alternative, the following are provided:

measuring means for measuring an electric characteristic of the electric power circuit;

a trip device of the mechanism connected to the measuring means and to the electromechanical relay to operate the electromechanical relay in response to the signal representative of an electric fault;

a high-speed opening device connected to the measuring means, to the electromechanical relay and to the electric power supply device, to operate both the electromechanical relay and the electromechanical actuator when the electric fault requires high-speed opening.

The latter solution provides an additional redundance at the level of control of the relay controlling opening of the mechanism.

According to another, preferred, alternative, the following are provided:

measuring means for measuring an electric characteristic of the electric power circuit;

a trip device of the mechanism connected to the measuring means and to the electromechanical relay to operate the electromechanical relay in response to the signal representative of an electric fault;

a high-speed opening device connected to the measuring means, to the trip device and to the electric power supply device, to operate both the electromechanical relay and the electromechanical actuator when the electric fault requires high-speed opening.

This solution in all cases enables opening of the relay to be commanded by means of the trip device, but specific tripping conditions of the relay to be imposed in the case where opening of the mechanism is preceded by separation of the contacts by the electromechanical actuator.

In a preferred practical application, the measuring means are formed by Rogowsky coils.

The electromechanical actuator is preferably constituted by a Thomson effect thruster. Any other very high-speed electromechanical thruster can naturally be envisioned.

BRIEF DESCRIPTION OF THE FIGURES

Other advantages and features will become more clearly apparent from the following description of particular embodiments of the invention given as non-restrictive examples only and represented in the accompanying drawings in which.

DETAILED DESCRIPTION OF AN EMBODIMENT

Figure 1:
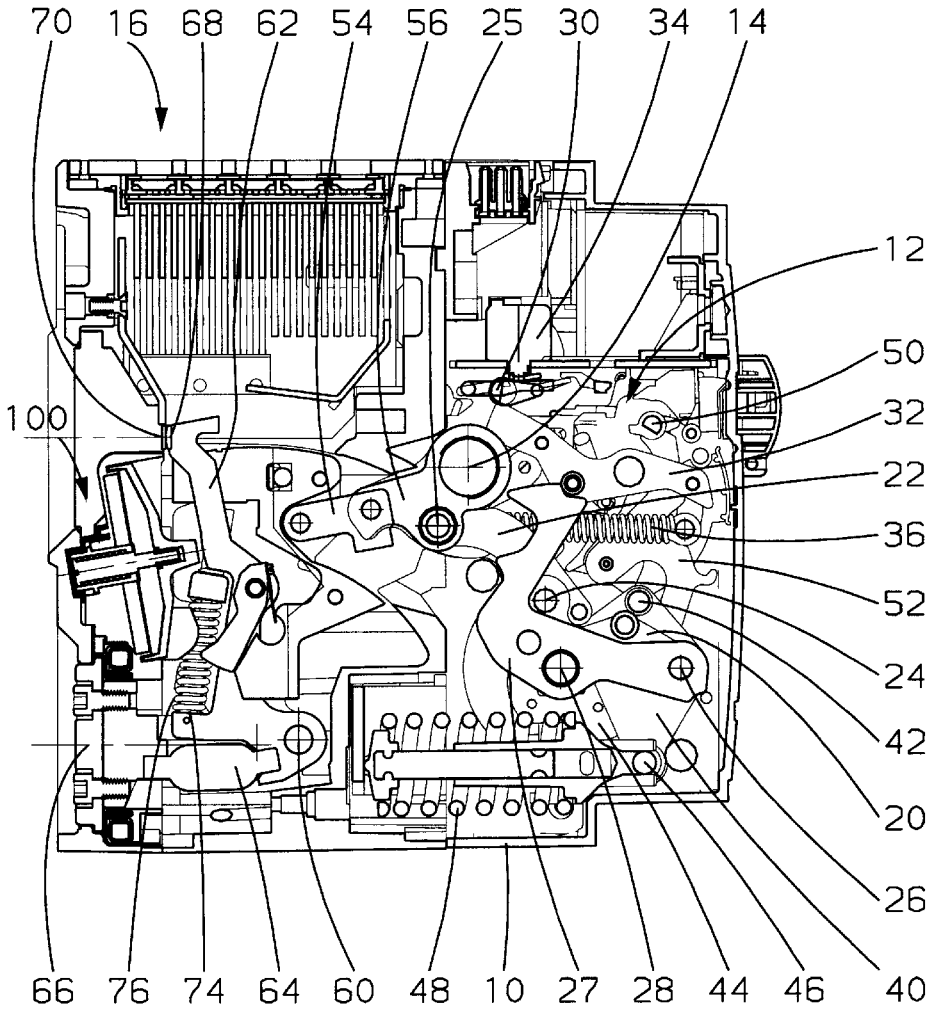
FIG. 1 represents a longitudinal cross-sectional view of a circuit breaker according to the invention, in a closed state.
Figure 2:
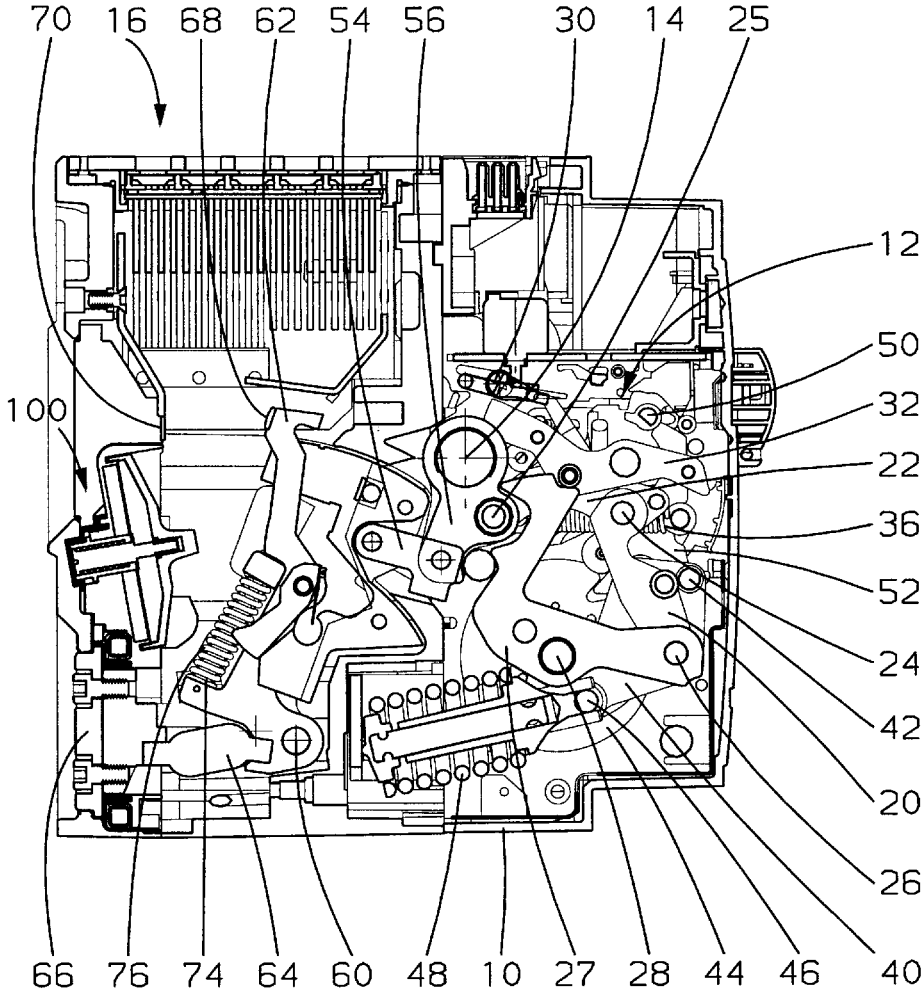
FIG. 2 represents a view of the circuit breaker of FIG. 1, in an open state.
Figure 3:
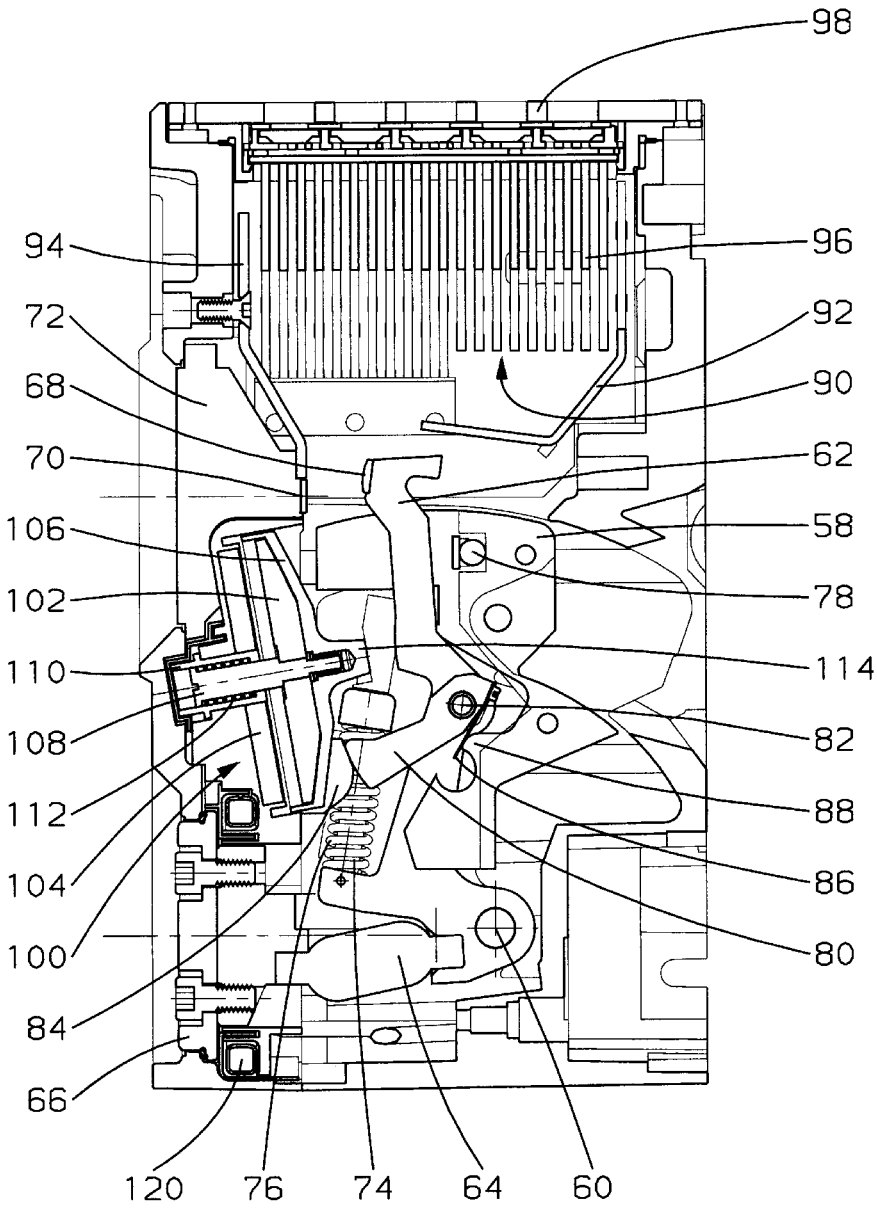
FIG. 3 represents a view of the circuit breaker of FIG. 1, in an intermediate blocked contact state.

With reference to FIGS. 1 to 3, a case 10 of a low-voltage power limiting circuit breaker made of insulating material houses a drive mechanism 12 in its front part for driving a swivelling switching bar 14 which transmits the movements of the mechanism 12 to pole-units 16 of the apparatus situated in the rear part.

The drive mechanism 12 is supported by a frame, not represented, fixed with respect to the case 10, and comprises a toggle device having a pair of transmission rods 20, 22, articulated with respect to one another by means of a spindle 24. The upper rod 22 is mechanically coupled to the switching bar 14 by means of a spindle 25. The lower rod 20 is articulated by means of a spindle 26 on a latch 27 rotating around a fixed swivel-pin 28. An opening catch 30 locks the latch 27 in a loaded position by means of a gearing down lever 32. The opening catch 30 is actuated by means of an electromagnetic relay 34. An opening spring 36 is fitted between the spindle 25 and a pin fixed to the frame.

The mechanism is completed by a loading and closing sub-assembly comprising a transmission lever 40 equipped with a spindle 42 operating in conjunction with the toggle device, with a roller following the curve of a loading cam 44 and with a spindle 46 for securing the end of a closing spring 48. The loading sub-assembly is completed by a closing catch 50 blocking the transmission lever 40 by means of a gearing down latch 52. In known manner, rotation of the loading cam 44 to its locked position enables the transmission lever 40 to be made to pivot from an unloaded position to a loaded position and loads the closing spring 48 without interfering with the opening mechanism. In the loaded position, the transmission lever 40 is locked by the closing catch 50. Unlocking of the lever 40 enables the closing spring 48 to drive the lever 40 from the loaded position to the unloaded position, the transmission spindle 42 then driving the toggle device to the closed position and loading the opening spring.

The switching bar 14 is common to all the pole-units 16 which can for example be three, four or six in number, although other configurations are possible, and is formed by a shaft supported by bearings of the case to swivel around a fixed geometric axis between an open position and a closed position. On each pole-unit there is arranged a connecting rod 54 which connects a crank 56 of the bar to a movable cage 58 made of insulating material. The cage 58 swivels around a geometric axis 60 fixed with respect to the frame. One or more movable contact fingers 62 are pivotally mounted around the same axis 60 and connected by a braid 64 to a connection terminal strip 66. The movable contact fingers 62 support contact pads 68 which, in the position of FIG. 1, come into contact with stationary contact pads 70 arranged on another connection terminal strip 72. Telescopic rods 74 guide contact pressure springs 76 arranged between the cage 58 and the fingers 62. The contact pressure springs 76 are, in the example considered, compression springs which tend to make the contact fingers 62 pivot counter-clockwise with respect to the cage 58 in the figures, so as to urge the contacts 68 of the fingers 62 towards the stationary contact 70. The cage 58 supports an elastomer end-of-travel stop 78 limiting the pivoting movement of the contact fingers 62. A retractable lateral latch 80 is articulated around a spindle 82 passing through the fingers and supported by the latter. A stop 84 is arranged on the back-plate of the case facing the latch 80. A spring blade 86 is fixed to one end of the latch 80, facing a beak 88 salient from the cage.

An arc extinguishing chamber 90 opens out facing the contacts, its aperture being bounded by a spark arrester 92 and an arcing horn 94 electrically connected to the connection terminal strip and to the stationary contact 70. The chamber houses metal cooling fins 96 and opens out onto the outside via a grate 98 opposite the contacts 68, 70.

A Thomson effect thruster 100 is arranged in the base of the case facing the contact fingers 62. In conventional manner, this thruster is formed by a disk 102 arranged facing a coil 104 and fixedly secured to a percussion head 106. A rod 108 is fixed to the head 106 and guided in a fixed cylinder 110. A return spring 112 tends to urge the head 106 towards the coil. The head 106 forms a hammer 114 designed to strike the contact fingers 62.

Figure 4:
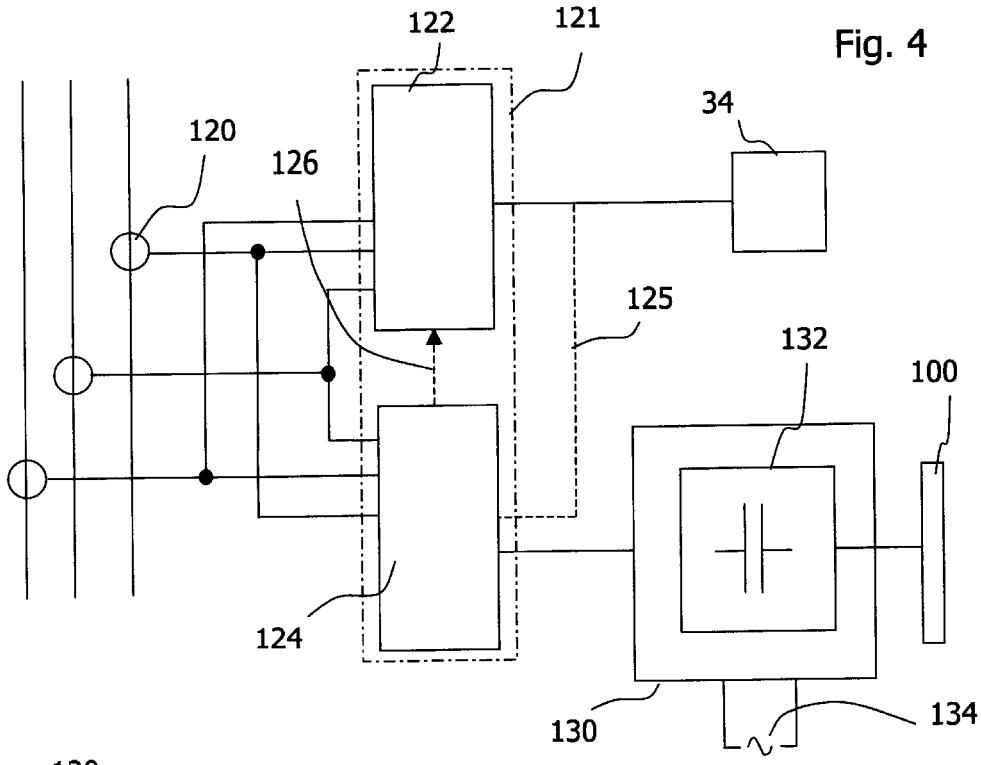
FIG. 4 represents a schematic view of a control and power supply circuit of a Thomson effect actuator of the circuit breaker of FIG. 1, according to a first embodiment.

A Rogowsky coil 120 surrounds the connection terminal strip 66 and measures the current flowing in the pole-unit 16. As shown in FIG. 4, the coils 120 of the three pole-units deliver a signal to a control unit 121 comprising a first electronic trip module 122 and a second electronic trip module 124. The first electronic module 122 operates the electromechanical relay 34 operating the opening catch 30 in very conventional manner. The second electronic module 124 operates both the electromechanical relay 34 and an electronic power module 130 supplying power to the Thomson effect thruster 100. However, the line 125 connecting the second electronic module 124 to the relay 34 is optional and can be omitted if required, which explains why it has been represented by a broken line. According to another alternative represented by the broken line 126, the second electronic module operates the electromagnetic relay 34 in case of high-speed opening occurring, via the module 122. The second module is able to determine whether the signal delivered by the coils 120 is characteristic of a fault requiring very high-speed opening of the circuit breaker. The means to make this decision are well known to the man of the trade and described for example in the document DE 3,642,136, and in the French Patent application bearing the registered number 01 15 785.

The electronic power module is provided with a bank of power capacitors to store the electric power necessary for activating the thruster 100. The module 130 is self-powered by a system power supply 134.

When an electric fault occurs that doesn't require a very fast response and extreme current limiting, the coil 120 delivers a signal such that only the first electronic module 122 send a signal to the electromechanical relay 34 which unlatches the opening catch 30. The opening spring 36 then drives the switching bar 14 to the open position represented in FIG. 2. This movement is transmitted to the cages 58 of the different pole-units 16 by the connecting rods 54. The contact fingers 62, urged by the contact pressure springs 76, follow the opening movement.

However, if the fault current was sufficiently large to generate an electromagnetic repulsion force between the contacts 68, 70, whose moment with respect to the axis 60 is greater than that of the contact pressure springs 76, the contact fingers 62 have pivoted clockwise causing an electric arc as soon as separation of the contacts 68, 70 occurs and thus causing current limiting, even before the mechanism 12 has driven the cages 58 to the open position. Due to the fact that these fingers 62 pivot before the cage 58 is set in motion, the spring blade 86 encounters the beak 88 of the cage and makes the latch 80 swivel with respect to the fingers 62 so that the latch 80 places itself between the fingers 62 and the stop 84. If the current decreases before the mechanism has driven the cage to the open position, the fingers 62 start to move counterclockwise but are immediately blocked in the position represented in FIG. 3, as the latch 80 has come into contact with the stop 84 and the contact fingers 62 from falling back. The latch is disabled by opening of the apparatus which causes the cage 58 to swivel, so that the beak 88 moves away from the spring blade 86. Depending on the versions, return to the retracted position of the latch 80 takes place by simple gravity or by means of a torsion spring, not represented in the figures, urging the latch 80 counterclockwise. Thus, for slow faults or faults of small amplitude, the circuit breaker acts as a conventional latching limiting circuit breaker.

The behavior of the circuit breaker in the event of a fast electric fault of large amplitude is of totally different nature. In such a case in fact, the second electronic trip module 124, the response time whereof is much shorter than that of the first trip module 122, takes priority. It operates both the power electronics 130 and, simultaneously or in delayed manner depending on the requirements, the electromagnetic relay 34. The power electronics 130 then instantaneously release the electric power stored in the capacitors 132 to the Thomson effect thruster 100. In less than a millisecond, the hammer 114 of the thruster head strikes the contact fingers 62 and projects the fingers which pivot clockwise around the axis 60, the cage 58 remaining immobile. As described beforehand in the case of electromagnetic repulsion, the fingers 62 come up against the stop 78 of the cage whereas the latch 80 swivels and moves into place. When the fingers start to redescend, the latch 80 impedes them as represented in FIG. 3. As soon as the contacts separate, an electric arc is drawn between the contacts. The shape of the copper parts forming the electric circuit between the connection terminal strips 66, 72 has a loop effect on the arc which projects the arc towards the chamber. The arc switches on the spark arrester 92 and on the arcing horn 94, which facilitates entry thereof into the arc extinguishing chamber 90 while sparing the contacts 68, 70. When the arc encounters the cooling fins 96, the arc is cooled so that its electric voltage increases until it is extinguished. The mechanism 12, with its own response time, confirms opening by driving the cage 58 to the open position of FIG. 2. The opening sequence comprises the same steps as in the case of electrodynamic repulsion, but it takes place much quicker. In fact less than three milliseconds elapse between the current zero and activation of the Thomson effect thruster, so that the arcing current intensity is very low and the arc is easy to break. If the electromagnetic repulsion effect between the contacts alone had to be relied on, it would be necessary to wait for the current intensity to have exceeded an already high limiting threshold, and separation of the contacts would give rise to a energetic arc right from the outset.

Naturally various modifications are possible.

Figure 5:
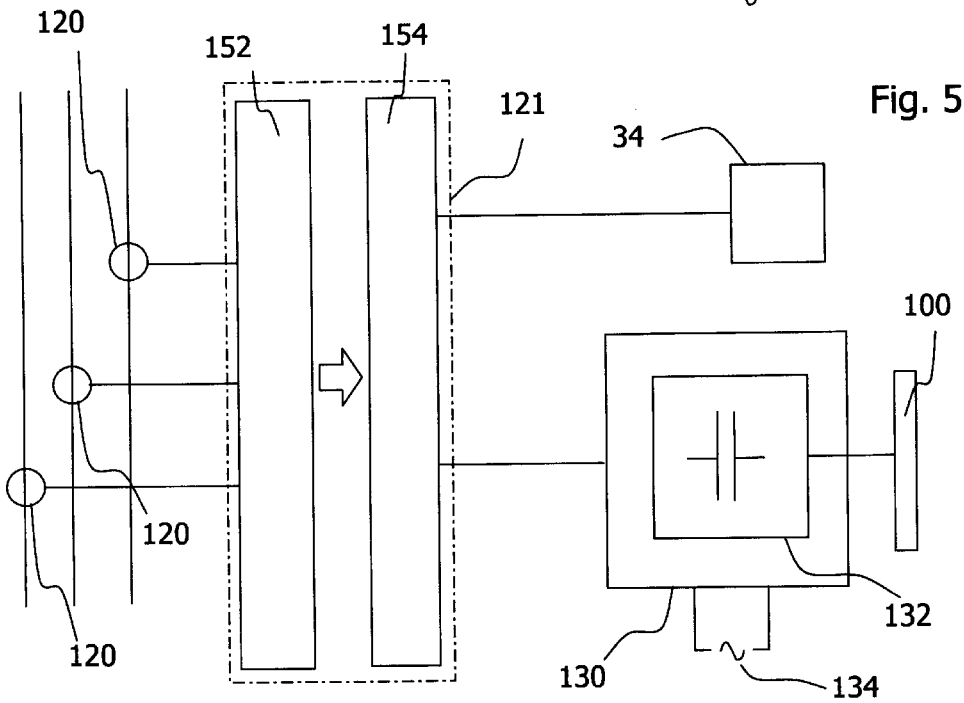
FIG. 5 represents a view of a control and power supply circuit of a Thomson effect actuator of the circuit breaker according to a second embodiment.

According to an alternative embodiment of the control circuit, represented in FIG. 5, the Rogowsky coils deliver their signal to an electronic control unit 121 which comprises a module for fault detection 152 and discrimination between faults requiring activation of the actuator 100 and a fault only requiring opening of the mechanism. Depending on the decision taken, the detection module 152 informs a control module 154 which sends the appropriate control signals to the relay 34 and/or to the electronic power module 130.

The multipole nature of the circuit breaker presented is not restrictive and the invention would also be applicable to single-pole switchgear.

The contact pressure springs can be arranged between the movable contact fingers and a member fixedly secured to the case, as described for example in the document U.S. Pat. No. 4,841,266. It can also be provided to perform the anti-return function of the wedge by means of the contact pressure springs forming a bistable system between the cage and the contact fingers, as described for example in the same document U.S. Pat. No. 4,841,266. Thus, when the contact fingers are near to the contact position, the return springs provide the contact pressure whereas, when the fingers are in the separated position, the springs tend to hold them in this position.

The contact pressure springs 76 can be calibrated in such a way that the contact fingers 62 never lift by electromagnetic repulsion effect before one of the trip devices has caused separation of the contacts, by opening the mechanism 12 or by activating the thruster 100. An apparatus with a high electrodynamic withstand is then obtained, achieving a very high limiting of extremely high currents by means of the thruster 100.

Two retractable lateral stops can be provided framing the cage if the width of the cage in a direction perpendicular to the plane of the figures makes this necessary. Other forms of stops can be envisioned. The retractable stop can be fixed to the back-plate of the case. It can also be arranged between the cage and the fingers.

If the available space allows it, the Thomson effect thruster or any other very high-speed actuator can be arranged on the cage to make the fingers swivel.

Detection of electric faults is naturally not necessarily limited to detection of short-circuits and overload currents. The opening latch can also be operated by undervoltage detection means which will act either on electromechanical relays distinct from the relay 36 or on the relay 36 itself.

The mechanism described in the embodiment is a mechanism of the type enabling an opening, closing, opening cycle with an opening spring and a closing spring distinct from one another. The invention is however applicable to any other type of conventional mechanism for a circuit breaker, wherein the energy required for opening is stored in an energy storage spring. It is in particular applicable to the circuit breaker whose mechanism comprises a single spring performing both opening on a fault and closing of the apparatus.

What is claimed is:

1. Electrical switchgear apparatus comprising:

a first contact connected to a first terminal strip for connection to an electric power circuit;

a cage movable between a closed position and an open position;

a second contact electrically connected to a second terminal strip for connection to the electric power circuit, the second contact being movable with respect to the cage between a contact position and a separated position, the second contact being in contact with the first contact when the cage is in the closed position and the second contact is in the contact position, a drive mechanism of the apparatus movable between a closed position and an open position, comprising:

an energy storage spring loaded when the drive mechanism is in the closed position and unloading when moving the drive mechanism from the closed position to the open position;

an opening latch, locking the drive mechanism in the open position;

an electromechanical relay for operation of the opening latch;

a kinematic transmission system between the energy storage spring and the cage to drive the cage from the closed position to the open position when the drive mechanism moves from the closed position to the open position;

comprising in addition:

an electromechanical actuator comprising a movable assembly moving between a rest position and an active position and driving the second contact from the contact position to the separated position going from the rest position to the active position when the cage is in the closed position.

2. The limiting electrical switchgear apparatus according to claim 1, comprising in addition a contact pressure spring urging the second contact to the contact position when the second contact is near to the contact position.

3. The limiting electrical switchgear apparatus according to claim 2, wherein the contact pressure spring bears on the movable cage.

4. The limiting electrical switchgear apparatus according to claim 2, wherein the contact pressure spring bears on a support of the apparatus, the second contact being connected to the cage by a kinematic link.

5. The limiting electrical switchgear apparatus according to claim 1, wherein the drive mechanism comprises closing means to move the drive mechanism from the open position to the closed position, the kinematic transmission system driving the cage from the open position to the closed position when the drive mechanism moves from the open position to the closed position.

6. The limiting electrical switchgear apparatus according to claim 5, wherein the closing means comprise a closing spring which relaxes to move the mechanism from the open position to the closed position.

7. The limiting electrical switchgear apparatus according to claim 1, comprising in addition a means for retaining the second contact in a retention position situated between the contact position and the separated position so long as the cage is in the closed position.

8. The limiting electrical switchgear apparatus according to claim 7, wherein the retention means includes an anti-return latch movable between a neutral position and an anti-return position and moving from the neutral position to the anti-return position when the second contact moves from the contact position to the separated position, the anti-return latch in the anti-return position locking the second contact in a locked position near to the separated position so long as the cage is in the closed position.

9. The limiting electrical switchgear apparatus according to claim 1, comprising in addition an arc extinguishing chamber equipped with means for absorbing energy given off by an electric arc drawn between the first contact and the second contact when the second contact is separated from the first contact, means for projecting an electric arc drawn between the first contact and the second contact by electromagnetic effect to the arc extinguishing chamber.

10. The limiting electrical switchgear apparatus according to claim 1, comprising in addition an electric power supply device to supply the electromechanical actuator and deliver the electric power required to make the movable assembly go from the rest position to the active position.

11. The limiting electrical switchgear apparatus according to claim 10, wherein the electric power supply device comprises an electric power storage means.

12. The limiting electrical switchgear apparatus according to claim 10, wherein the electric power supply device is connected to an electric source independent from the electric power circuit.

13. The limiting electrical switchgear apparatus according to claim 10, comprising in addition:

means for detecting electric faults and for discriminating between electric faults requiring high-speed opening and electric faults not requiring high-speed opening;

operating means to operate both the electromechanical relay and the electric power supply device when the means for detecting and discriminating have decided that the electric fault requires high-speed opening and to operate the electromechanical relay alone when the means for detecting and discriminating have decided that the electric fault does not require high-speed opening.

14. The limiting electrical switchgear apparatus according to claim 10, comprising in addition:

measuring means for measuring an electric characteristic of the electric power circuit;

a trip device of the mechanism connected to the measuring means and to the electromechanical relay to operate the electromechanical relay;

a high-speed opening device connected to the measuring means and to the electric power supply device to operate the electromechanical actuator when the electric fault requires high-speed opening.

15. The limiting electrical switchgear apparatus according to claim 10, comprising in addition:

measuring means for measuring an electric characteristic of the electric power circuit;

a trip device of the mechanism connected to the measuring means and to the electromechanical relay to operate the electromechanical relay in response to the signal representative of an electric fault;

a high-speed opening device connected to the measuring means, to the electromechanical relay and to the electric power supply device, to operate both the electromechanical relay and the electromechanical actuator when the electric fault requires high-speed opening.

16. The limiting electrical switchgear apparatus according to claim 10, comprising in addition:

measuring means for measuring an electric characteristic of the electric power circuit;

a trip device of the mechanism connected to the measuring means and to the electromechanical relay to operate the electromechanical relay in response to the signal representative of an electric fault;

a high-speed opening device connected to the measuring means, to the trip device and to the electric power supply device, to operate both the electromechanical relay and the electromechanical actuator when the electric fault requires high-speed opening.

17. The limiting electrical switchgear apparatus according to claim 1, wherein the electromechanical actuator is constituted by a Thomson effect thruster.

* * * * *